US007717635B1

(12) United States Patent
Schmidig

(10) Patent No.: US 7,717,635 B1
(45) Date of Patent: May 18, 2010

(54) LIQUID DISPENSING BRUSH

(76) Inventor: Jennifer Schmidig, 49655 87 th St. W., Lancaster, CA (US) 93536

( * ) Notice: Subject to any disclaimer, the term of this patent is extended or adjusted under 35 U.S.C. 154(b) by 0 days.

(21) Appl. No.: 12/638,909

(22) Filed: Dec. 15, 2009

Related U.S. Application Data

(63) Continuation-in-part of application No. 12/291,488, filed on Nov. 12, 2008.

(51) Int. Cl.
*A46B 5/02* (2006.01)
*A47L 13/22* (2006.01)

(52) U.S. Cl. ..... 401/6; 401/205; 401/280; 401/281; 401/291; 222/506

(58) Field of Classification Search ..... 401/6, 401/205, 207, 270, 277, 280, 281, 291; 222/502, 222/503, 505, 506, 519–521, 548; 251/304
See application file for complete search history.

(56) References Cited

U.S. PATENT DOCUMENTS 2,622,258 A * 12/1952 Giraud ..... 401/194
4,652,162 A * 3/1987 Ladd et al. ..... 401/123
6,425,701 B1 6/2002 Jacobs
6,439,790 B1 8/2002 Kay
6,536,977 B1 * 3/2003 Hammel ..... 401/205
6,616,364 B2 9/2003 Katz et al.
6,932,533 B1 * 8/2005 Chen ..... 401/281
7,503,715 B2 3/2009 Khubani

* cited by examiner

*Primary Examiner*—David J Walczak
(74) *Attorney, Agent, or Firm*—Marc E. Hankin; Kevin Schraven; Hankin Patent Law, APC

(57) ABSTRACT

A liquid dispensing cleaning or scrubbing device that includes a handle and a scrubbing head. The handle is hollow and holds a cleaning liquid. The head twists from an open position to a closed position. When the head is an open position, the user pushes a button on the back of the head to deliver a substantial amount of cleaning liquid to the bottom of the scrubbing head. The head receives liquid through a re-sealable inset screw cap filler port. The filler port is on the bottom of the head, and when the scrubbing device is fully assembled the filler port is completely and conveniently out of the user's way.

20 Claims, 11 Drawing Sheets

LIQUID DISPENSING BRUSH

CROSS-REFERENCE TO RELATED APPLICATIONS

This application is a continuation-in-part of prior non-provisional application Ser. No. 12/291,488, filed on Nov. 12, 2008, entitled "Spa-ah Brush," to inventor Jennifer Schmidig, the contents of which are expressly incorporated as though set forth in full herein.

FIELD OF INVENTION

This invention generally relates to brushes. Moreover, it pertains specifically to a brush with a hollow, soap filled handle and brush head that twists open and closed to allow the soap to be dispensed.

BACKGROUND

A back brush is a bathing tool used for the purpose of personal hygiene. Back scrubbers are useful for washing the back or other hard to reach areas of the body. The typical back brush has a wooden or plastic handle and a sponge, mesh, or brush head on one end of the handle.

There are many references that disclose handled back brushes, including, U.S. Pat. No. 6,439,790, issued to Kay. Kay discloses a back brush with a hollow, soap filled handle that releases soap on to the brush head by engaging a dispensing knob. After the soap flows onto the brush head, the user may then scrub the desired area of the body. The dispensing holes disclosed and claimed in Kay are two small holes in the center of the brush that are twisted to align with two brush head apertures. When the holes are aligned with the apertures, soap is allowed to flow through the holes and out through the apertures. The problem with this design is that the user is uncertain when the brush is an open or closed position. Because of this, the user may accidentally leave the brush in the open position and have the soap leak out when not in use. Additionally, the user may accidently bump the brush knob to the closed position and cut off the soap flow while in use.

Other references that disclose handled back brushes include U.S. Pat. No. 6,616,364, issued to Katz, U.S. Pat. No. 7,503,715, issued to Khubani, and U.S. Pat. No. 6,425,701, issued to Jacobs. These devices all disclose a hollow, soap filled handle with a hole in the brush head to dispense the soap. However, the mechanism for dispensing the soap in these references is a standard pushing or pumping mechanism and does not allow the user to twist the brush head to shut off the flow of soap. Additionally, these brushes do not have a plurality of holes and apertures that align in order to allow the free flow of a substantial amount of soap onto the brush head or that unalign to completely cut off the flow of soap. Furthermore, the filler valves disclosed in these references are generally inconvenient and inadequate for repeated fillings. Finally, the prior art does not afford the user efficiency of operating the components of the brush. For example, the prior art does not make it easy for the users to change cleaning heads, open and close the fluid holes, or hide the filler openings.

Thus, what is needed, is a hollow brush that has a discreet filler valve and that allows the user to twist the brush head open to allow the soap to flow out and closed to completely cut off the flow of soap.

SUMMARY OF THE INVENTION

To minimize the limitations in the prior art, and to minimize other limitations that will become apparent upon reading and understanding the present specification, the present invention discloses a bathing or scrubbing device that receives liquid through a re-sealable inset screw cap opening and holds this liquid within a head and hollow handle. The scrubber head twists from an open position to a closed position (and back again) and dispenses a substantial amount of liquid when in the open position. The liquid is dispensed by pushing a push button at the top of the head. The filler port is on the bottom of the head, and when the scrubber is fully assembled the filler port is completely and conveniently out of the user's way.

One embodiment of this invention is a cleaning liquid dispensing device, comprising: an inner gear head; an outer gear head; and a gear head receptacle. The inner gear head is hollow and is comprised of a side portion, a top portion, and a bottom ring portion. The side portion includes a plurality of outer notches. The outer notches are on an outside of the side portion. The bottom ring portion of the inner gear head includes a plurality of holes. The outer gear head is comprised of a bottom ring portion, a side portion, and a top lip portion. The side portion includes a plurality of inner notches on an inside of the side portion. The bottom ring includes a plurality of apertures. The inner gear head is inserted into the outer gear head, and wherein the plurality of inner notches of the outer gear head matingly engage with the plurality of outer notches of the inner gear head. The inner gear head is rotatable with respect to the outer gear head. The inner notches of the outer gear head and the outer notches of the inner gear head limit rotation of the inner gear head with respect to the outer gear head. The inner gear head rotates with respect to the outer gear head such that the plurality of inner gear head holes and the plurality of outer gear head apertures shift from an unaligned position to an aligned position and from the aligned position to the unaligned position. The aligned position allows a cleaning liquid to flow through the plurality of inner gear head holes and the plurality of outer gear head apertures. The unaligned position prevents the cleaning liquid from flowing through the plurality of inner gear head holes and the plurality of outer gear head apertures. The gear head receptacle is comprised of a base portion, a side portion, a top ring portion, a cleaning portion, and an inner gear head engagement device. The gear head receptacle inner gear head engagement device extends proximally from an inside of the side portion of the gear head receptacle. The base portion includes a plurality of holes. The cleaning portion is attached to an outside of said base portion. The outer gear head is inserted into the gear head receptacle. The side portion of the outer gear head includes an inner gear head engagement device opening. The inner gear head engagement device opening allows the inner gear head engagement device to pass through the outer gear head and engage with the inner gear head. The inner gear head engagement device of the gear head receptacle engages the inner gear head such that the plurality of gear head receptacle base ring holes and the plurality of inner gear head holes are aligned and wherein the inner gear head and the gear head receptacle are not rotatable with respect to each other. Preferably the inner gear head engagement device is a pin, wherein the inner gear head pin engages with one or more of the plurality of outer notches of the inner gear head. Preferably, the inner gear head pin engages the inner gear head between two of the plurality of outer notches of the inner gear head.

The cleaning liquid dispensing device preferably includes a screw cap and the outer gear head is further comprised of a threaded protrusion, wherein the threaded protrusion extends proximally from an inside of the bottom ring of the outer gear head. The screw cap is threaded and matingly engages with the threaded protrusion of the outer gear head. The inner gear head top portion is a push button. The push button is engaged to pump a cleaning liquid out of the cleaning liquid dispensing device when the plurality of gear head receptacle base ring holes and the plurality of inner gear head holes are aligned. The top ring portion of the gear head receptacle includes a removable portion that is removed to allow the outer gear head to slide into the gear head receptacle. The removable portion of the gear head receptacle top ring portion is preferably hingedly connected to the top ring portion and the removable portion hinges distally away from the gear head receptacle to allow the outer gear head to slide more easily into the gear head receptacle.

Preferably the outside of the side portion of the outer gear head is threaded and includes a tab. The gear head receptacle further comprises a tab notch and wherein the inside of the side portion of the gear head receptacle is threaded. The threaded outer gear head and the threaded gear head receptacle engage matingly when the outer gear head is inserted into the gear head receptacle. The tab allows a user to rotate the outer gear head easily with respect to the gear head receptacle.

The cleaning liquid dispensing device preferably includes a handle. The handle is preferably hollow and attached to the inner gear head.

An object of the present invention is to provide an easy to use and easy to fill liquid dispensing brush that will overcome the deficiencies of the prior art.

Another object of the present invention is to provide a liquid dispensing brush that has a rotatable head that allows the user to twist the brush from an open to a closed position. The liquid dispensing brush, when open delivers a substantial amount of cleaning liquid and when closed completely restricts the flow of liquid.

Another object of the present invention is to provide a liquid dispensing brush that is easy to assemble, disassemble, clean, and replace worn parts.

Another object of the present invention is to provide a liquid dispensing brush with interchangeable brush heads so that a user can choose which type of cleaning brush head they wish to use. The present invention preferably allows the user to use many different types of brushes, sponges, or loofahs as the devices cleaning or scrubbing surface/head.

Other features and advantages are inherent in the liquid dispensing device claimed and disclosed will become apparent to those skilled in the art from the following detailed description and its accompanying drawings.

DETAILED DESCRIPTIONS OF THE DRAWINGS

In the following detailed description of the preferred embodiment, reference is made to the accompanying drawings that form a part hereof, and in which is shown by way of illustration a specific embodiment in which the invention may be practiced. It is to be understood that other embodiments may be utilized and structural changes may be made without departing from the scope of the present invention.

In the following detailed description of various embodiments of the invention, numerous specific details are set forth in order to provide a thorough understanding of various aspects of one or more embodiments of the invention. However, one or more embodiments of the invention may be practiced without these specific details. In other instances, well-known methods, procedures, and/or components have not been described in detail so as not to unnecessarily obscure aspects of embodiments of the invention.

The present invention is preferably made primarily of plastic. However, it should be understood that the brush or any part of the brush may be made from of any natural or artificial material without deviating from the scope of the invention. Additionally, the parts of the present invention are preferably connected together using friction, friction snaps, or threaded and screwable parts. However, it should be understood that the present invention may be connected using any means including, but not limited to: straps, zip-ties, chains, clips, binders, bungees, cords, ropes, strings, cables, fasteners, staples, hook and loop, bands, latches, stitches, snaps, wenches, glue, other natural or synthetic chemical adhesives, adhesive tape, heat bonding, chemical bonding, crimps, clamps, or ultrasonic welding. Additionally, it should be understood that the invention may be made from one contiguous piece or may be made from any number of pieces without deviating from the scope of the invention. Additionally, rubber gaskets and rings may be used to fit between any pieces and help prevent any liquid leakage.

Figure 1:
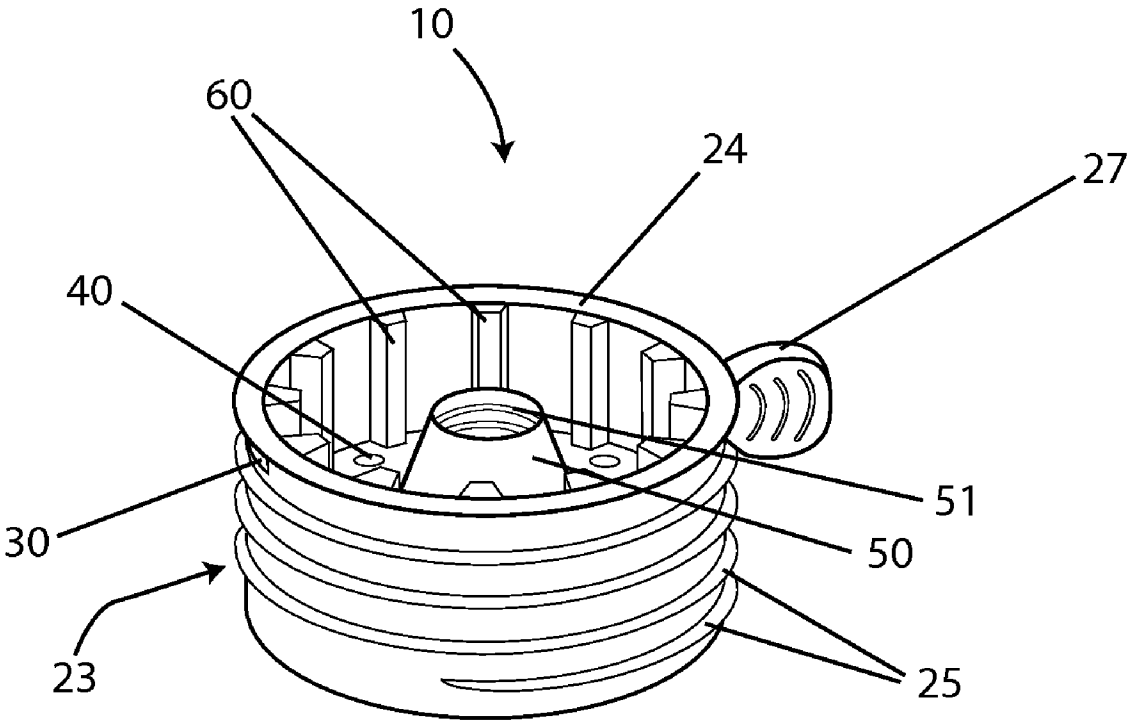
FIG. 1 is an illustration of a perspective view of the outer gear head of one embodiment of the cleaning liquid dispensing device.
Figure 3:
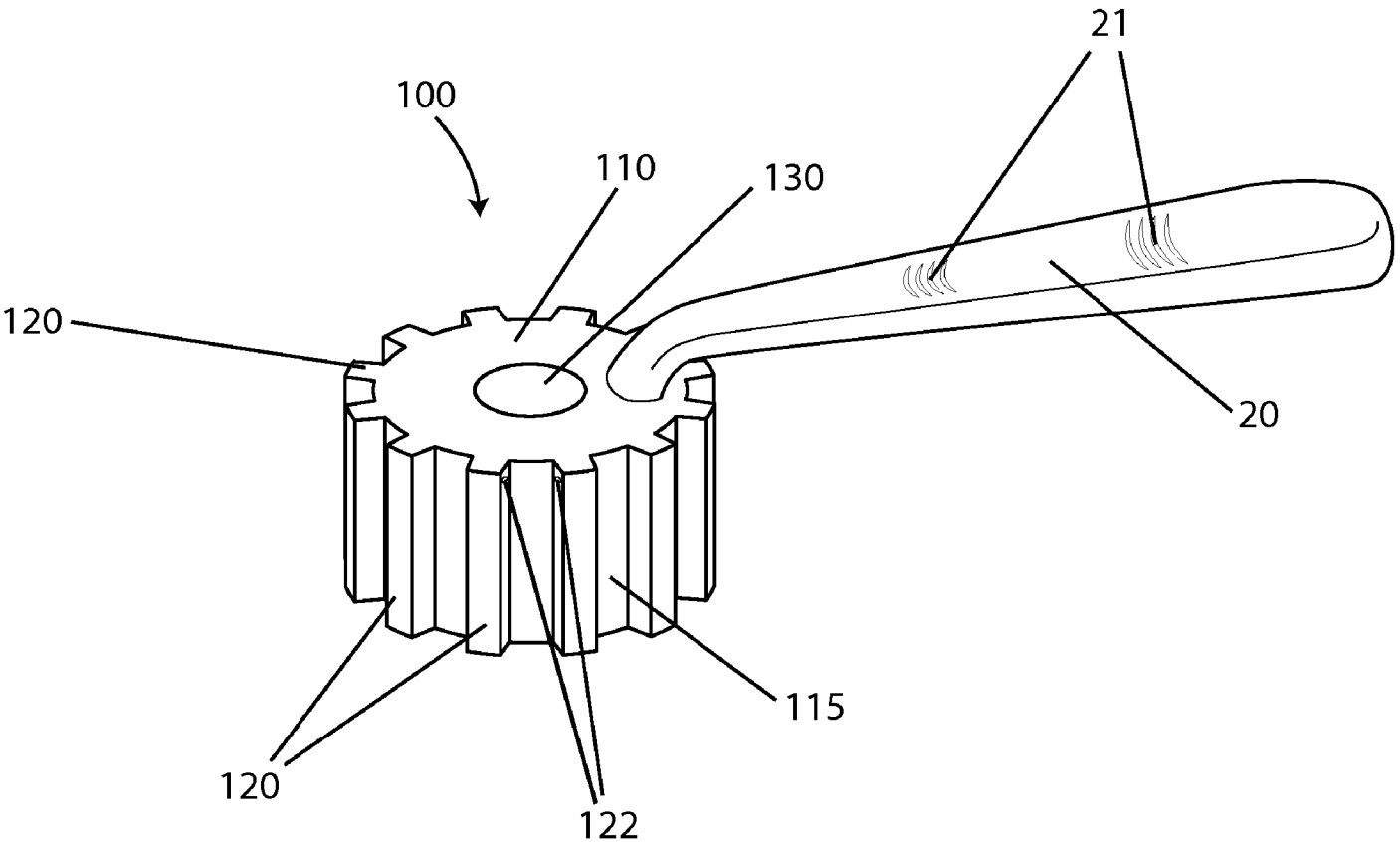
FIG. 3 is an illustration of a perspective view of the inner gear head of one embodiment of the cleaning liquid dispensing device.

FIG. 1 is an illustration of a perspective view of the outer gear head of one embodiment of the cleaning liquid dispensing device. As shown in FIG. 1 the cleaning liquid dispensing device preferably includes outer gear head 10. Outer gear head 10 preferably includes side portion 23, top lip 24, side threading 25, tab 27, opening 30, apertures 40, protrusion 50, protrusion outer threading 51, and inner notches 60. The handle 20 is preferably hollow and holds a liquid, which is preferably a cleaning liquid. As shown the protrusion 50 is preferably open at the top so as to allow the cleaning liquid to flow into the outer gear head 10 through inner gear head 100 and handle 20 (inner gear head 100 and handle 20 are shown in FIG. 3). The inner notches 60 and apertures 40 are preferably evenly spaced within the outer gear head 10. Tab 27 preferably projects outward from outer gear head 10 and is easily grasped by a user.

Figure 2:
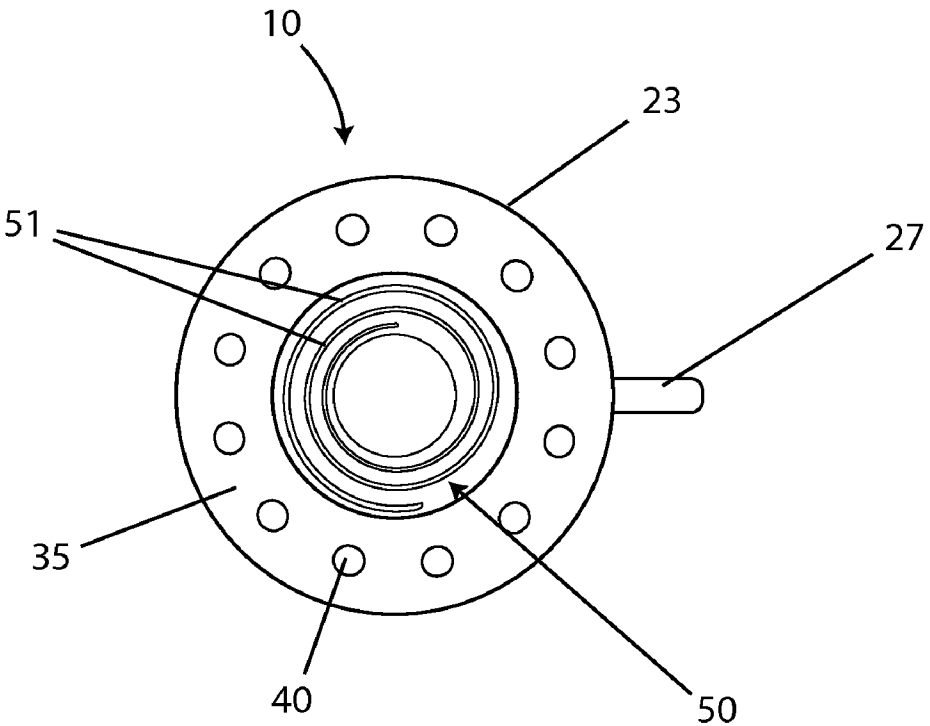
FIG. 2 is an illustration of a bottom plan view of the outer gear head of one embodiment of the cleaning liquid dispensing device.

FIG. 2 is an illustration of a bottom plan view of the outer gear head of one embodiment of the cleaning liquid dispensing device. As shown in FIG. 2, the outer gear head 10 preferably has, side portion 23, tab 27, bottom ring 35, apertures 40, protrusion 50, and protrusion outer threading 51. FIG. 2 shows how apertures 40 are preferably evenly spaced in bottom ring 35. The apertures 40 allow a cleaning liquid to flow out of the outer gear head.

FIG. 3 is an illustration of a perspective view of the inner gear head of one embodiment of the cleaning liquid dispensing device. The cleaning liquid dispensing device preferably includes an inner gear head 100. As shown in FIG. 3, the inner gear head 100 preferably includes handle 20, handle grips 21, top portion 110, side portion 115, outer notches 120, inner gear head engagement pin divots 122, and button 130. FIG. 3 shows how the outer notches 120 are preferably evenly spaced around side portion 115. Button 130 is preferably an engagable push button and when pushed acts to pump the cleaning liquid out of the cleaning liquid device. Button 130 preferably is configured to allow air into the device to replace the exiting fluid. The divots 122 may be notches, grooves, holes, or protuberances, so long as they function to hold the receptacle engagement device. Handle 20 is preferably hollow and holds a reserve of cleaning liquid.

Figure 4:
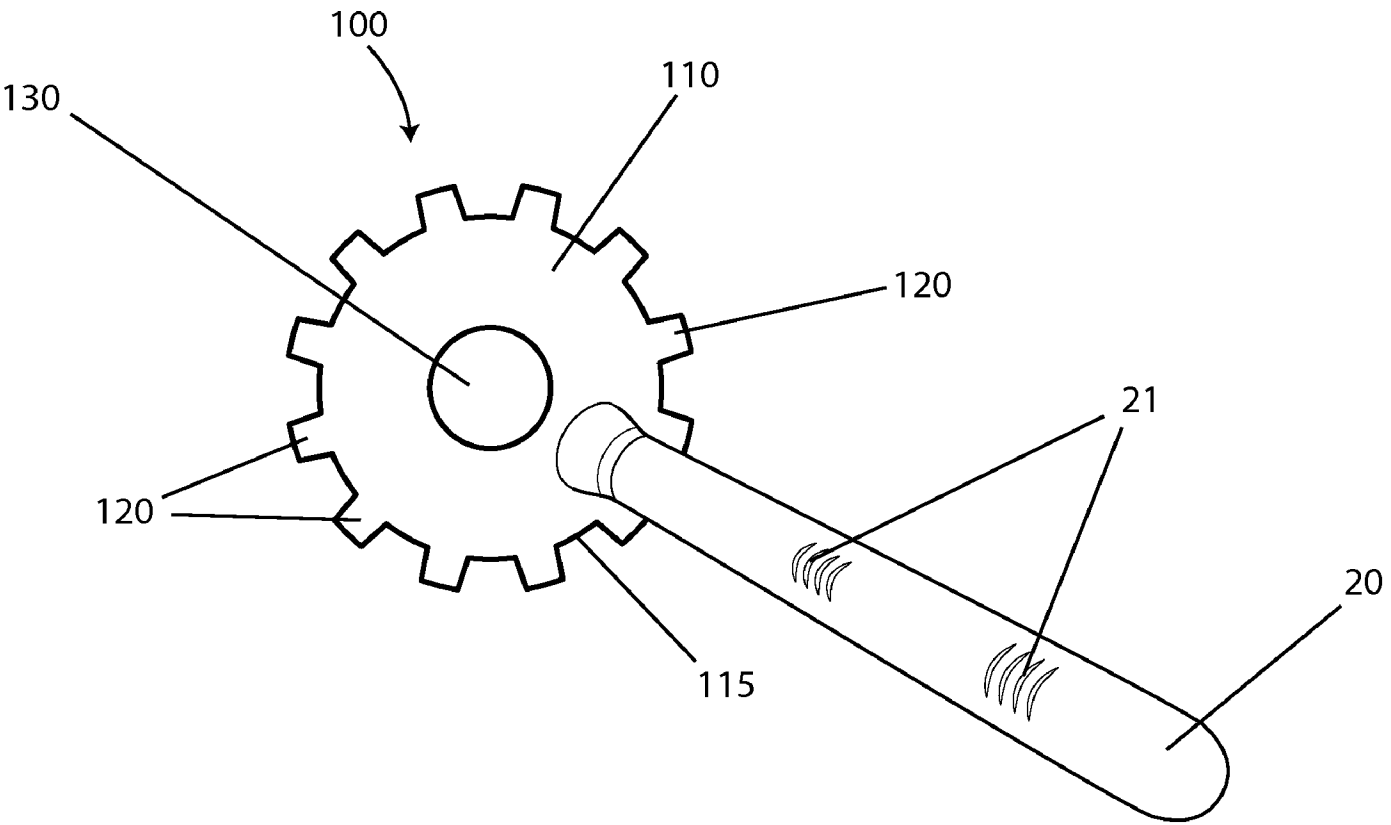
FIG. 4 is an illustration of a top plan view of the inner gear head of one embodiment of the cleaning liquid dispensing device.

FIG. 4 is an illustration of a top plan view of the inner gear head of one embodiment of the cleaning liquid dispensing device. As shown in FIG. 4, the inner gear head 100 includes handle 20, handle grips 21, top portion 110, side portion 115, outer notches 120, and button 130. FIG. 4 shows how the outer notches 130 are preferably evenly spaced around side portion 115.

Figure 5:
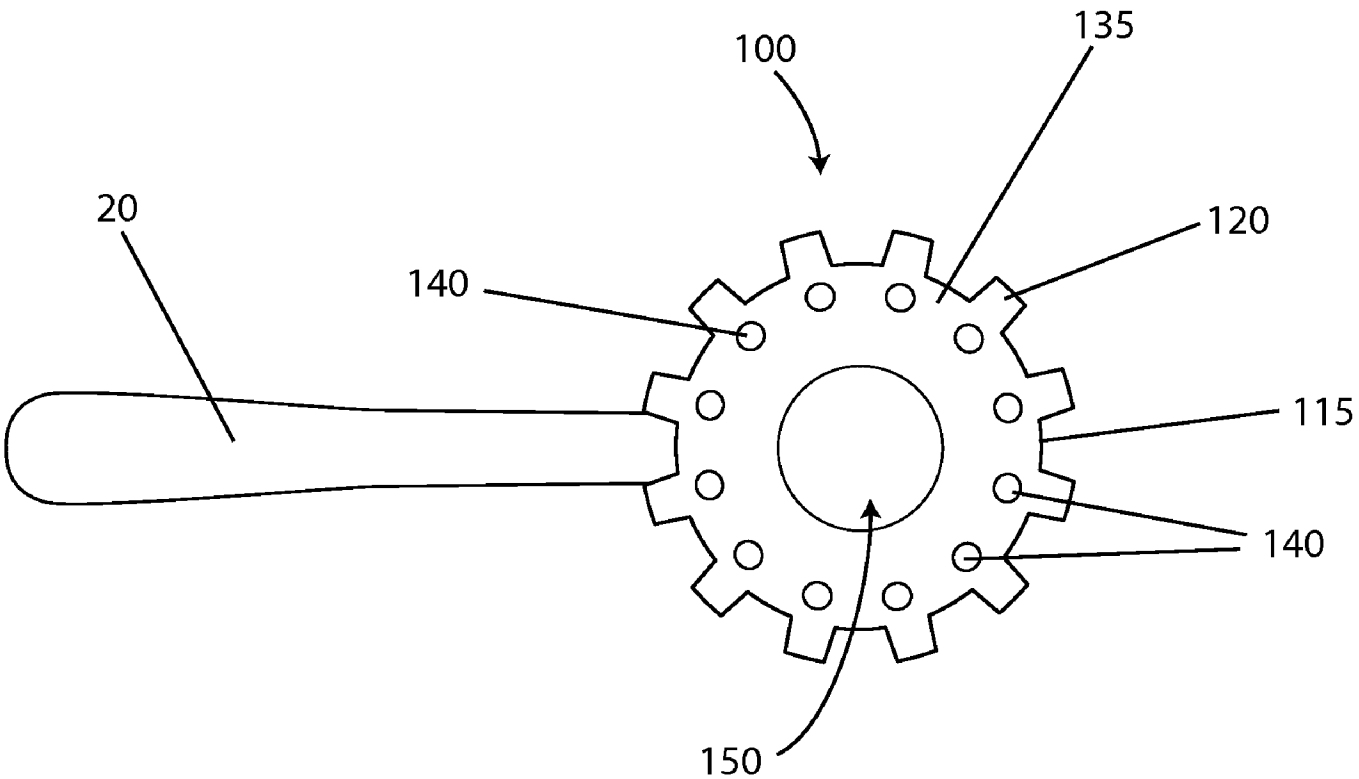
FIG. 5 is an illustration of a bottom plan view of the inner gear head of one embodiment of the cleaning liquid dispensing device.

FIG. 5 is an illustration of a bottom plan view of the inner gear head of one embodiment of the cleaning liquid dispensing device. As shown in FIG. 5, the inner gear head 100 includes handle 20, side portion 115, outer notches 120, bottom ring portion 135, holes 140, and bottom opening 150. FIG. 4 shows how the holes 140 are preferably evenly spaced around bottom ring portion 135. Inner gear head 100 is preferably hollow and is designed to fit into outer gear head 10. Specifically, bottom opening 150 fits matingly around protrusion 50 (shown in FIG. 1). The holes 140 are preferably the same size and have the same spacing configuration as the apertures 40 (shown in FIG. 2).

Figure 6:
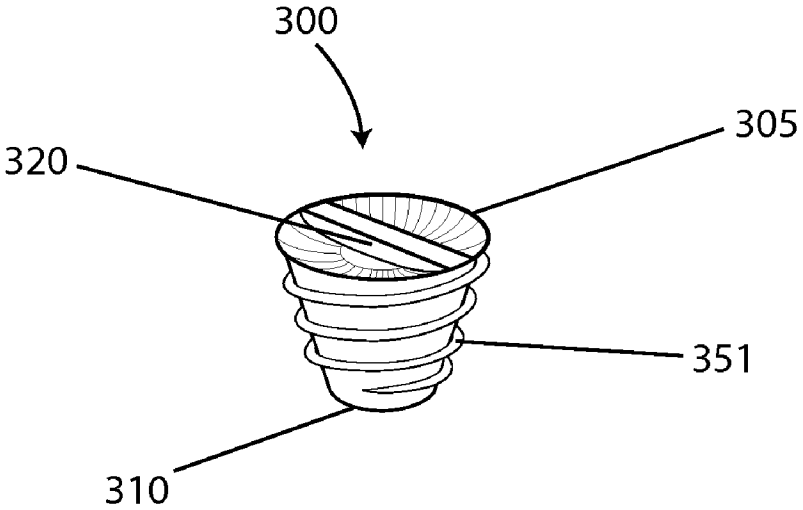
FIG. 6 is an illustration of a perspective view of the screw cap of one embodiment of the cleaning liquid dispensing device.

FIG. 6 is an illustration of a perspective view of the screw cap of one embodiment of the cleaning liquid dispensing device. The cleaning liquid dispensing device preferably includes screw cap 300. As shown in FIG. 6, screw cap 300 preferably includes top portion 305, bottom portion 310, inset dial 320, and outer threading 351. Screw cap 300 is preferably designed to screw into the outside of protrusion 50. Inset dial 320 is preferably level with top portion 305 such that when screw cap 300 is screwed into protrusion 50 (not shown in FIG. 6), screw cap 300 is flush with bottom ring portion 35 (as shown in FIG. 2). Inset dial 320 is preferably a flat tab that is inset into top portion 305 such that when inset dial 320 is turned, the entire screw cap 300 turns. With this preferred design, the screw cap, or filling cap, when not in use, is conveniently out of the user's way. This out of the way design prevents unnecessary protrusions. Additionally, the screw cap may incorporate a rubber ring or gasket to prevent any unwanted leakage.

Figure 7:
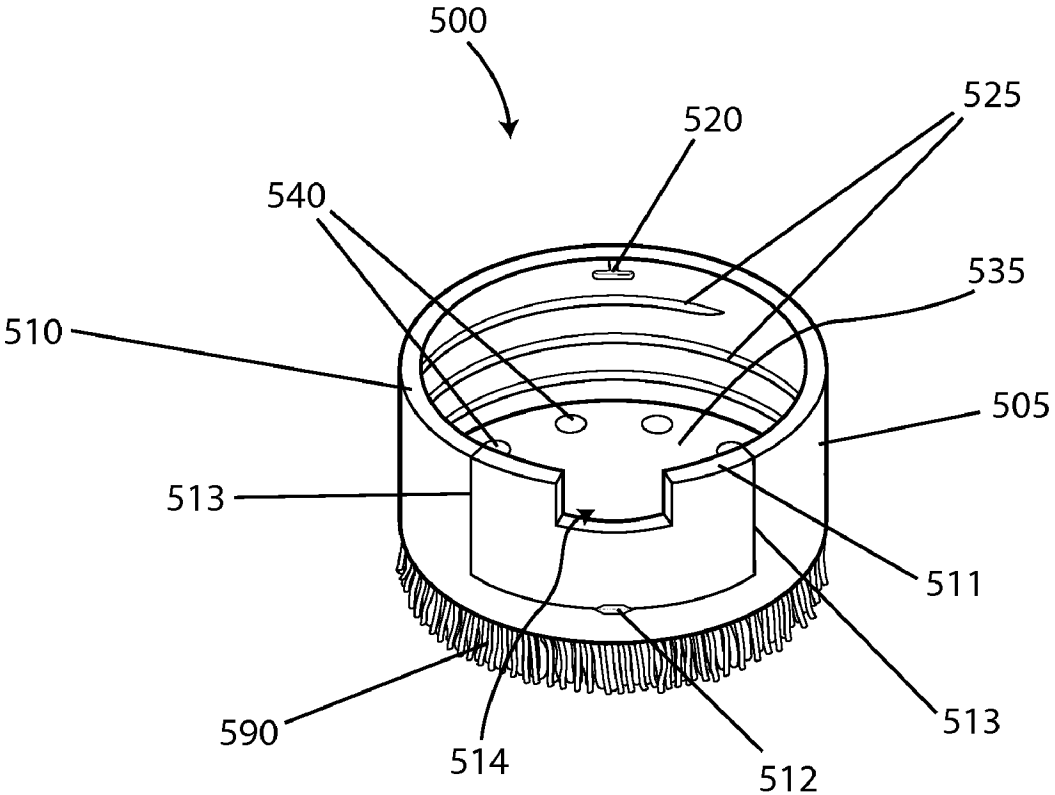
FIG. 7 is an illustration of a perspective view of the gear head receptacle of one embodiment of the cleaning liquid dispensing device.

FIG. 7 is an illustration of a perspective view of the gear head receptacle of one embodiment of the cleaning liquid dispensing device. The cleaning liquid dispensing device preferably includes a gear head receptacle 500. As shown in FIG. 7, gear head receptacle 500 is preferably hollow and includes side portion 505, top lip 510, removable portion 511, hinge 512, removable portion edges 513, tab notch 514, inner gear head engagement pin 520, inner threading 525, bottom portion 535, holes 540, and cleaning portion 590. Preferably gear head receptacle 500 is designed to receive and threadingly engage with outer gear head 10. Preferably removable portion 511 hinges on hinge 512 and flips out of the way so that outer gear head 10 can easily slide inside of gear head receptacle 500. After the outer gear head 10 is inserted into gear head receptacle 500, removable portion 511 then flips up on hinge 512 and closes around outer gear head 10. This prevents gear head 10 from accidently coming out of gear head receptacle 500. Removable portion 511 is preferably held in place by friction snaps or sliding bar locks at removable portion edges 513.

The inner threading 525 engages with side threading 25 of the outer gear head 10 (as shown in FIG. 1). The engaged threading allows the outer gear head 10 to turn and tighten into an engaged position with respect to the gear head receptacle 500. Inner gear head engagement pin 520 preferably fits through opening 30 (as shown in FIG. 1) and engages with inner gear head engagement pin divots 122 (as shown in FIG. 3). Inner gear head engagement pin 520 links the inner gear head 100 and the gear head receptacle such that they do not rotate or twist with respect to each other. Additionally, when engaged the inner gear head holes 140 and the gear head receptacle holes 540 are preferably aligned vertically with each other.

Tab notch 514 is preferably configured to fit around tab 27 (shown in FIG. 1). Tab 27 preferably slides back and forth within tab notch 514.

FIG. 7 also shows how the bottom of gear head receptacle 500 is covered by a cleaning portion 590. In this case, cleaning portion 590 is a standard bristle brush. When the cleaning liquid passes through holes 540, the liquid is delivered directly to the base of cleaning portion 590. In this manner the user may easily apply a cleaning liquid to the cleaning portion 590. Although the cleaning liquid is preferably a soap, lotion, or other viscous liquid cleaning product, it should be understood that the cleaning liquid may be any liquid or fluid. Additionally, although a standard bristle brush is one possible embodiment of the cleaning portion, the cleaning portion may be any cleaning device, including but not limited to: scrubber, scrubbing brush, mop, cloth, sponge, mesh sponge, natural sponge, loofah sponge, pad, scouring pad, or loofah, without deviating from the scope of the invention.

Figure 8:
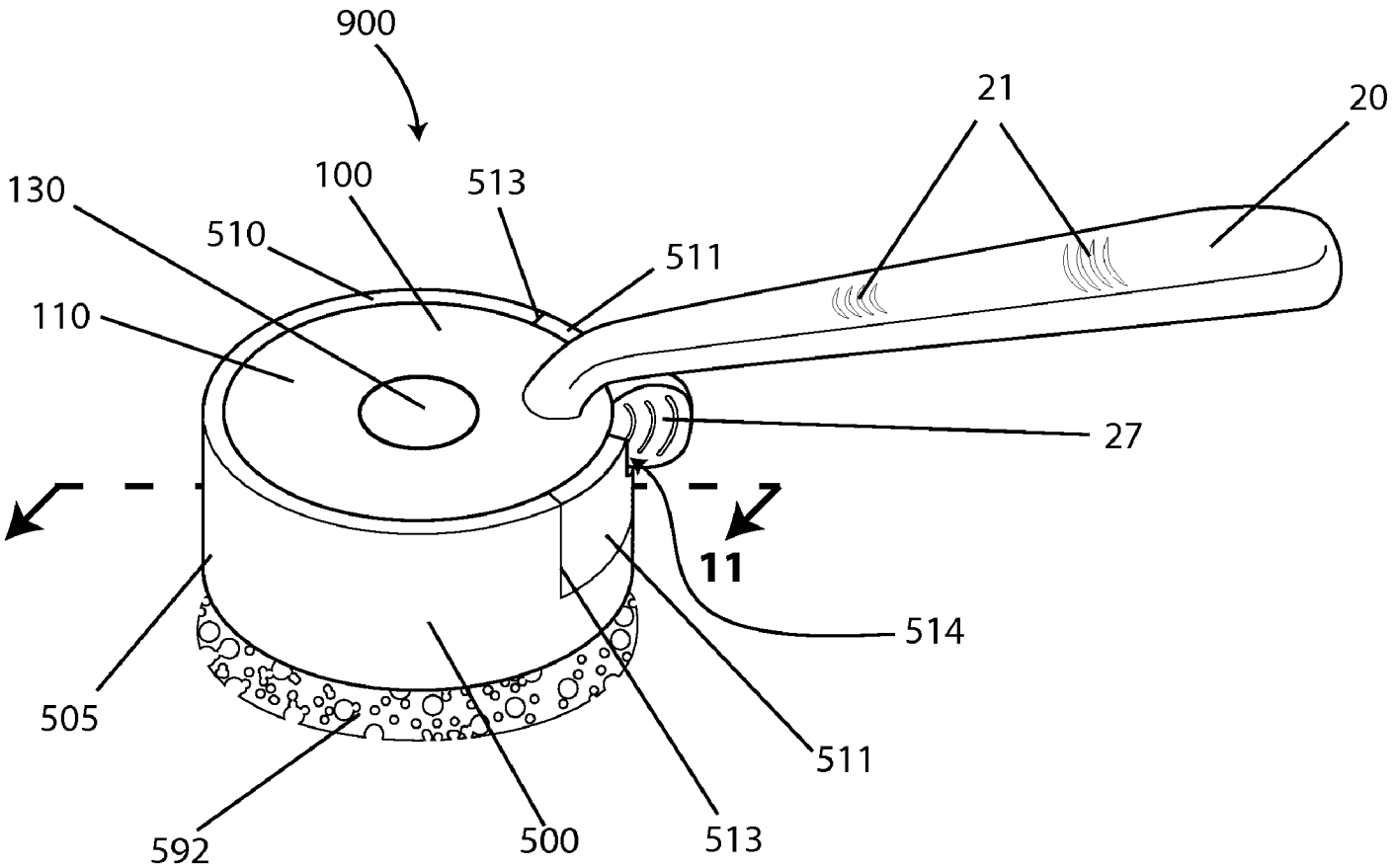
FIG. 8 is an illustration of a perspective view of one embodiment of the cleaning liquid dispensing device.

FIG. 8 is an illustration of a perspective view of one embodiment of the cleaning liquid dispensing device. As shown in FIG. 8 the cleaning liquid dispensing device 900 is preferably comprised of outer gear head 10 (hidden from view in FIG. 8), handle 20, handle grips 21, tab 27, inner gear head 100, inner gear head top portion 110, inner gear head button 130, gear head receptacle 500, gear head receptacle side portion 505, gear head receptacle top lip 510, removable portion 511, removable portion edges 513, tab notch 514, and sponge cleaning surface 592. FIG. 8 shows the cleaning liquid dispensing device 900 assembled and ready to use. FIG. 8 shows inner gear head 100 as inserted into outer gear head 10, which itself has been inserted into gear head receptacle 500. FIG. 8 shows that the cleaning surface as a sponge. Tab 27 and tab notch 514 are shown in FIG. 8 as being positioned underneath handle 20. However, tab 27 and tab notch 514 may be located anywhere on cleaning liquid dispensing device 900 without deviating from the scope of the invention. Furthermore, it should be understood that there may be more than one tab 27 and tab notch 514 without deviating from the scope of the invention.

The user is preferably able to grasp tab 27, which is connected to outer gear head 10 and twist or rotate outer gear head 10 with respect to gear head receptacle 500. The user may hold the receptacle steady by grasping gear head receptacle side portion 505 or by holding the handle 20. When the outer gear head 10 is twisted with respect to the gear head receptacle 500, the apertures 40 align with both the holes 140 and holes 540. When the outer gear head 10 is twisted in the other direction with respect to the gear head receptacle 500, the apertures 40 shift back to an unaligned position relative to both the holes 140 and holes 540. In this manner, the user is able to securely slide open and securely slide closed the device.

Figure 9:
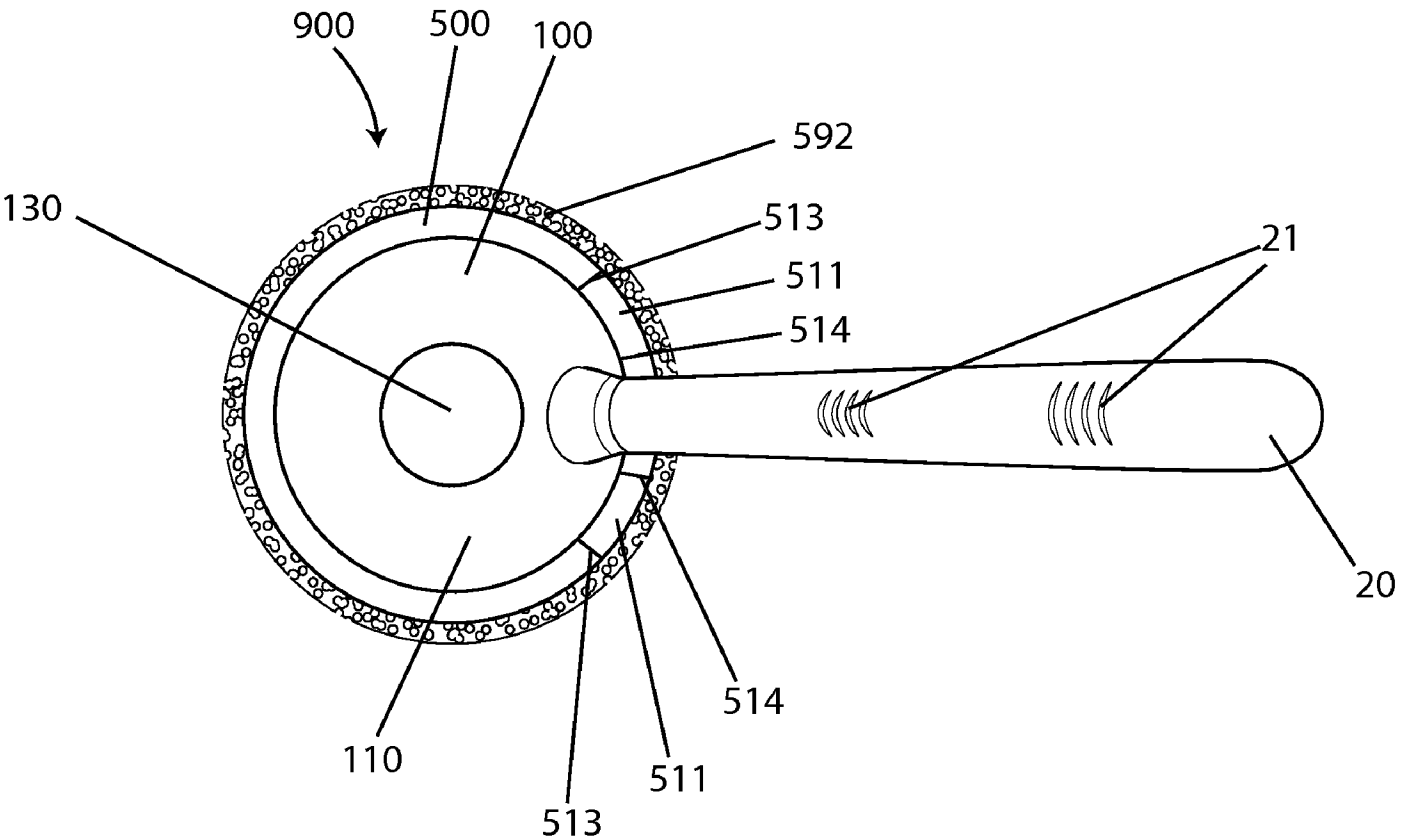
FIG. 9 is an illustration of a top plan view of one embodiment of the cleaning liquid dispensing device.

FIG. 9 is an illustration of a top plan view of one embodiment of the cleaning liquid dispensing device. As shown in FIG. 9 the cleaning liquid dispensing device 900 is preferably comprised of outer gear head 10 (hidden from view in FIG. 8), inner gear head 100, inner gear head top portion 110, handle 20, handle grips 21, inner gear head button 130, gear head receptacle 500, gear head receptacle top lip 510, removable portion 511, removable portion edges 513, tab notch 514, and sponge cleaning surface 592. Tab 27 is not visible in FIG. 9 because it is hidden by handle 20.

Figure 10:
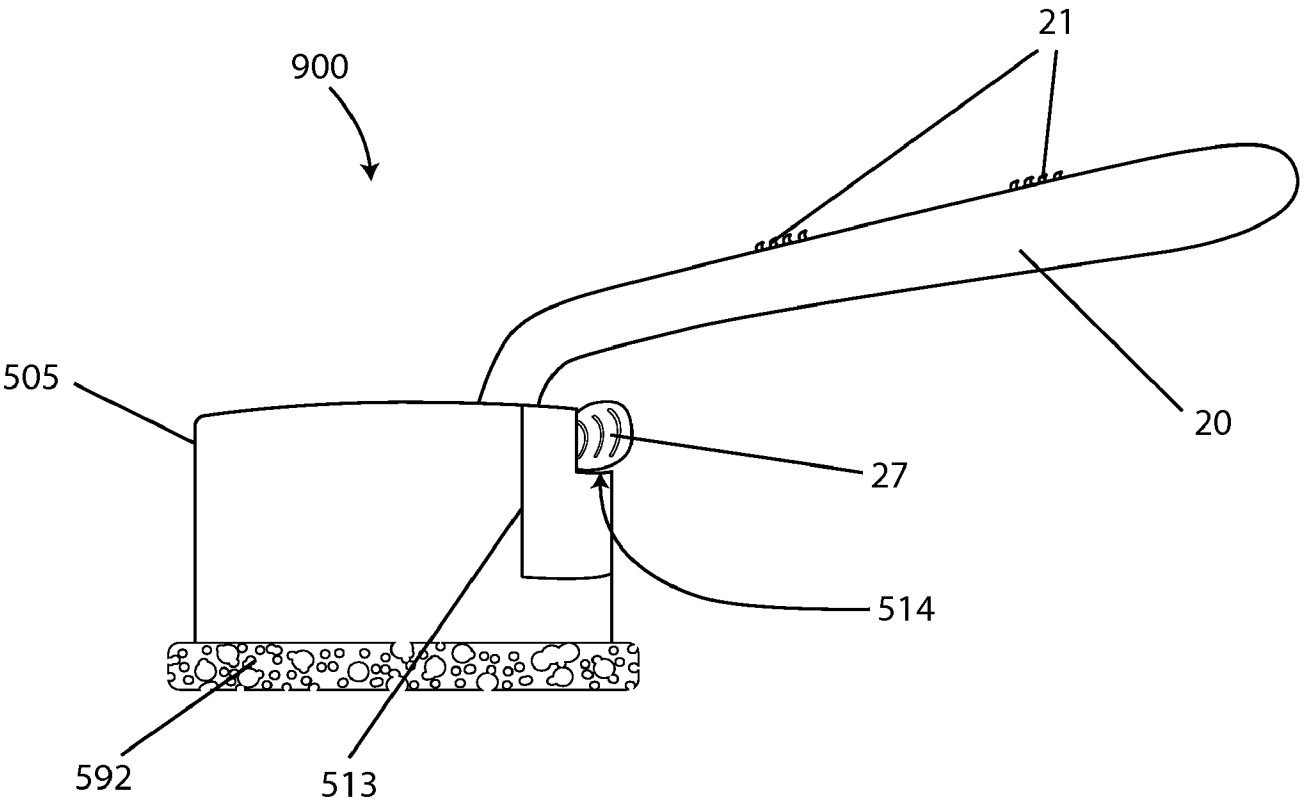
FIG. 10 is an illustration of a side plan view of one embodiment of the cleaning liquid dispensing device.

FIG. 10 is an illustration of a side plan view of one embodiment of the cleaning liquid dispensing device. As shown in FIG. 10 the cleaning liquid dispensing device 900 is preferably comprised of handle 20, handle grips 21, tab 27, gear head receptacle side portion 505, removable portion edges 513, and tab notch 514, and sponge cleaning surface 592.

Figure 11:
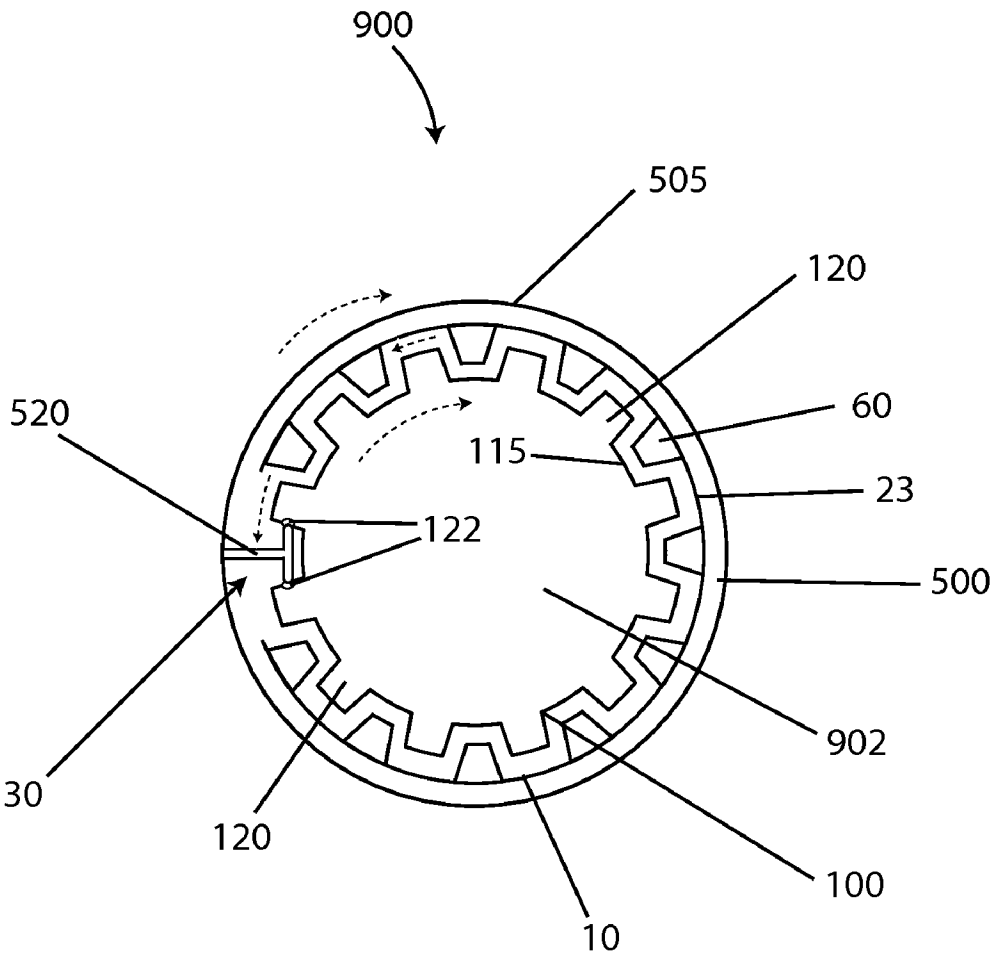
FIG. 11 is an illustration of a cross-section view of one embodiment of the cleaning liquid dispensing device.

FIG. 11 is an illustration of a cross-section view of one embodiment of the cleaning liquid dispensing device. FIG. 11 is a cross-section view of the cleaning liquid dispensing device 900. As shown in FIG. 11, the liquid dispensing device 900 preferably includes outer gear head 10, outer gear head side portion 23, outer gear head opening 30, outer gear head inner notches 60, inner gear head 100, inner gear head outer notches 120, inner gear head engagement pin divots 122, gear head receptacle 500, gear head receptacle side portion 505, and gear head receptacle inner gear head engagement pin 520. FIG. 11 also shows how liquid dispensing device 900 has a hollow inside 902. FIG. 11 shows how the gear head receptacle 500 and the inner gear head 100 engage through the inner gear head engagement pin 520. As shown in FIG. 11, inner gear head engagement pin 520 passes through opening 30 and engages with inner gear head engagement pin divots 122. This engagement preferably locks inner gear head 100 with gear head receptacle 500 such that when one is rotated the other rotates in the same direction.

FIG. 11 also shows how opening 30 will allow the inner gear head engagement pin 520 to slide within the length of the opening. As such, the outer gear head 10 is not completely encumbered by inner gear head engagement pin 520. Additionally, the inner notches 60 and outer notches 120 are preferably offset such that outer gear head 10 and the engaged combination of inner gear head 100/gear head receptacle 500 are able to rotate in opposite directions with respect to each other. However, this rotation is limited when the inner notches 60 contact the outer notches 120. This rotation is also limited and assisted by the outer threading of the outer gear head 10 and the inner threading of the gear head receptacle 500. Indeed, this threading preferably allows the user to smoothly twist the outer gear head 10 in the opposite direction to the engaged combination of inner gear head 100/gear head receptacle 500. The movement arrows in FIG. 11 show how the inner gear head 100 moves with gear head receptacle 500 but twists against outer gear head 10.

As discussed above, when the inner gear head 100 is engaged with gear head receptacle 500, their respective bottom holes 140 and 540 (as shown in FIGS. 5 and 7) are vertically aligned. When the cleaning liquid dispensing device 900 is completely assembled, the outer gear head bottom ring 35 (shown in FIG. 2) is preferably sandwiched between the inner gear head bottom ring portion 135 (as shown in FIG. 5) and gear head receptacle bottom portion 535 (as shown in FIG. 7). In this manner, when the outer gear head 10 twists or rotates against the engaged combination of inner gear head 100/gear head receptacle 500, the outer gear head apertures 40 shift from being aligned and not being aligned with the bottom holes 140 and 540. When apertures 40 are aligned with bottom holes 140 and 540, the cleaning liquid contained within the cleaning liquid dispensing device is able to flow through the aligned openings. The plurality of openings allow a substantial amount of liquid to flow or be pumped out to the cleaning surface. When apertures 40 are twisted so that they are not aligned with bottom holes 140 and 540, the cleaning liquid is, preferably, completely restricted. Therefore, the user is able to easily twist the device on and off. Preferably, the engaged combination of inner gear head 100/gear head receptacle 500 twists clockwise with respect to the outer gear head 10 to align the openings (turn on) and then counter clockwise to unalign the openings (turn off). These twisting movements are restricted by inner notches 60, outer notches 120, inner gear head engagement pin 520, outer threading 25 and inner threading 525. However, although inner notches 60 and outer notches 120 are the primary twist restriction mechanism, the notches also are configured and spaced to allow the holes 140 and 540 to completely align with apertures 40 so that a substantial amount of liquid can flow through the aligned holes and apertures. Additionally, the primary function of the inner gear head engagement pin 520 is not to restrict the twist, but instead it is to connect inner gear head 100 to gear head receptacle 500 and hold inner gear head 100 in a static position relative to gear head receptacle 500. Furthermore, the primary function of outer threading 25 and inner threading 525 is to allow the cleaning liquid dispensing device to smoothly twist between an on position and an off position and to securely keep the device in either the on or off position.

Preferably the user twists the outer gear head 10 with respect to gear head receptacle 500 by grasping tab 27, which is connected to outer gear head 10, in one hand, and holding gear head receptacle side portion 505 in the other hand, and twisting them in opposite directions. In this manner, the device is easily twisted open and closed.

Although there are preferably twelve (12) apertures 40, twelve (12) holes 140, and twelve (12) holes 540, there may be any number of these openings without deviating from the scope of the invention.

In summary, the present invention is a cleaning liquid dispensing brush that twists to allow the cleaning liquid to flow onto the base of the brush.

The foregoing description of the preferred embodiment of the invention has been presented for the purposes of illustration and description. While multiple embodiments are disclosed, still other embodiments of the present invention will become apparent to those skilled in the art from the above detailed description, which shows and describes illustrative embodiments of the invention. As will be realized, the invention is capable of modifications in various obvious aspects, all without departing from the spirit and scope of the present invention. Accordingly, the detailed description is to be regarded as illustrative in nature and not restrictive. Also, although not explicitly recited, one or more embodiments of the invention may be practiced in combination or conjunction with one another. Furthermore, the reference or non-reference to a particular embodiment of the invention shall not be interpreted to limit the scope the invention. It is intended that the scope of the invention not be limited by this detailed description, but by the claims and the equivalents to the claims that are appended hereto.

What is claimed is:

1. A liquid dispensing device, comprising:

an inner gear head;

an outer gear head; and a gear head receptacle;

wherein said inner gear head is hollow and is comprised of a side portion, a top portion, and a bottom ring portion;

wherein said side portion includes a plurality of outer notches;

wherein said plurality of outer notches are on an outside of said side portion;

wherein said bottom ring portion of said inner gear head includes a plurality of holes;

wherein said outer gear head is comprised of a bottom ring portion, a side portion, and a top lip portion;

wherein said side portion includes a plurality of inner notches on an inside of said side portion;

wherein said bottom ring includes a plurality of apertures;

wherein said inner gear head is inserted into said outer gear head, and wherein said plurality of inner notches of said outer gear head matingly engage with said plurality of outer notches of said inner gear head;

wherein said inner gear head is rotatable with respect to said outer gear head;

wherein said inner notches of said outer gear head and said outer notches of said inner gear head limit rotation of said inner gear head with respect to said outer gear head;

wherein said inner gear head rotates with respect to said outer gear head such that said plurality of inner gear head holes and said plurality of outer gear head apertures shift from an unaligned position to an aligned position and from said aligned position to said unaligned position;

wherein said aligned position allows a liquid to flow through said plurality of inner gear head holes and said plurality of outer gear head apertures;

wherein said unaligned position prevents said liquid from flowing through said plurality of inner gear head holes and said plurality of outer gear head apertures;

wherein said gear head receptacle is comprised of a base portion, a side portion, a top ring portion, a cleaning portion, and an inner gear head engagement device;

wherein said gear head receptacle inner gear head engagement device extends proximally from an inside of said side portion of said gear head receptacle;

wherein said base portion includes a plurality of holes;

wherein said cleaning portion is attached to an outside of said base portion;

wherein said outer gear head is inserted into said gear head receptacle;

wherein said side portion of said outer gear head includes an inner gear head engagement device opening;

wherein said inner gear head engagement device opening allows said inner gear head engagement device to pass through said outer gear head and engage with said inner gear head;

wherein said inner gear head engagement device of said gear head receptacle engages said inner gear head such that said plurality of gear head receptacle base portion holes and said plurality of inner gear head holes are aligned and wherein said inner gear head and said gear head receptacle are not rotatable with respect to each other.

2. The liquid dispensing device of claim 1, wherein said inner gear head engagement device is a pin;

wherein said inner gear head pin engages with one or more of said plurality of outer notches of said inner gear head.

3. The liquid dispensing device of claim 2, wherein said inner gear head pin engages said inner gear head between two of said plurality of outer notches of said inner gear head.

4. The liquid dispensing device of claim 3, further comprising:

a screw cap;

wherein said outer gear head is further comprised of a threaded protrusion, wherein said threaded protrusion extends proximally from an inside of said bottom ring of said outer gear head;

wherein said screw cap is threaded and matingly engages with said threaded protrusion of said outer gear head.

5. The liquid dispensing device of claim 4, wherein said inner gear head top portion includes a push button;

wherein said push button is engaged to pump a liquid out of said liquid dispensing device when said plurality of gear head receptacle base ring holes and said plurality of inner gear head holes are aligned with said plurality of outer gear head apertures.

6. The liquid dispensing device of claim 5, wherein said gear head receptacle includes a removable portion that is removed to allow said outer gear head to slide into said gear head receptacle.

7. The liquid dispensing device of claim 6, wherein said removable portion of said gear head receptacle is hingedly connected to said side portion of said gear head receptacle and said removable portion hinges distally away from said gear head receptacle to allow said outer gear head to slide into said gear head receptacle.

8. The liquid dispensing device of claim 7, wherein an outside of said side portion of said outer gear head is threaded and includes a tab;

wherein said gear head receptacle further comprises a tab notch;

wherein said inside of said side portion of said gear head receptacle is threaded;

wherein said threaded outer gear head and said threaded gear head receptacle engage matingly when said outer gear head is inserted into said gear head receptacle;

wherein said tab allows a user to rotate said outer gear head with respect to said gear head receptacle.

9. The liquid dispensing device of claim 8, further comprising:

a handle;

wherein said handle is attached to said inner gear head.

10. The liquid dispensing device of claim 9, wherein said handle is hollow.

11. A liquid dispensing device, comprising:

an inner gear head;

an outer gear head;

a gear head receptacle; and a screw cap;

wherein said inner gear head is hollow and is comprised of a side portion, a top portion, and a bottom ring portion;

wherein said side portion includes a plurality of outer notches;

wherein said plurality of outer notches are on an outside of said side portion;

wherein said bottom ring portion of said inner gear head includes a plurality of holes;

wherein said outer gear head is comprised of a bottom ring portion, a side portion, and a top lip portion;

wherein said side portion includes a plurality of inner notches on an inside of said side portion;

wherein said bottom ring includes a plurality of apertures;

wherein said inner gear head is inserted into said outer gear head, and wherein said plurality of inner notches of said outer gear head matingly engage with said plurality of outer notches of said inner gear head;

wherein said inner gear head is rotatable with respect to said outer gear head;

wherein said inner notches of said outer gear head and said outer notches of said inner gear head limit rotation of said inner gear head with respect to said outer gear head;

wherein said inner gear head rotates with respect to said outer gear head such that said plurality of inner gear head holes and said plurality of outer gear head apertures shift from an unaligned position to an aligned position and from said aligned position to said unaligned position;

wherein said aligned position allows a liquid to flow through said plurality of inner gear head holes and said plurality of outer gear head apertures;

wherein said unaligned position prevents said liquid from flowing through said plurality of inner gear head holes and said plurality of outer gear head apertures;

wherein said outer gear head is further comprised of a threaded protrusion, wherein said threaded protrusion extends proximally from an inside of said bottom ring of said outer gear head;

wherein said gear head receptacle is comprised of a base portion, a side portion, a top ring portion, a cleaning portion, and an inner gear head engagement device;

wherein said gear head receptacle inner gear head engagement device extends proximally from an inside of said side portion of said gear head receptacle;

wherein said base portion includes a plurality of holes;

wherein said cleaning portion is attached to an outside of said base portion;

wherein said outer gear head is inserted into said gear head receptacle;

wherein said side portion of said outer gear head includes an inner gear head engagement device opening;

wherein said inner gear head engagement device opening allows said inner gear head engagement device to pass through said outer gear head and engage with said inner gear head;

wherein said inner gear head engagement device of said gear head receptacle engages said inner gear head such that said plurality of gear head receptacle base portion holes and said plurality of inner gear head holes are aligned and wherein said inner gear head and said gear head receptacle are not rotatable with respect to each other;

wherein said screw cap is threaded and matingly engages with said threaded protrusion of said outer gear head.

12. The liquid dispensing device of claim 11, wherein said inner gear head engagement device is a pin;

wherein said inner gear head pin engages with one or more of said plurality of outer notches of said inner gear head.

13. The liquid dispensing device of claim 12, wherein said inner gear head pin engages said inner gear head between two of said plurality of outer notches of said inner gear head.

14. The liquid dispensing device of claim 13, wherein said gear head receptacle includes a removable portion that is removed to allow said outer gear head to slide into said gear head receptacle.

15. The liquid dispensing device of claim 14, wherein said removable portion of said gear head receptacle is hingedly connected to said side portion of said gear head receptacle and said removable portion hinges distally away from said gear head receptacle to allow said outer gear head to slide into said gear head receptacle.

16. The liquid dispensing device of claim 1, wherein said gear head receptacle includes a removable portion that is removed to allow said outer gear head to slide into said gear head receptacle.

17. The liquid dispensing device of claim 16, wherein said removable portion of said gear head receptacle is hingedly connected to said side portion of said gear head receptacle and said removable portion hinges distally away from said gear head receptacle to allow said outer gear head to slide into said gear head receptacle.

18. The liquid dispensing device of claim 17, further comprising:

a screw cap;

wherein said outer gear head is further comprised of a threaded protrusion, wherein said threaded protrusion extends proximally from an inside of said bottom ring of said outer gear head;

wherein said screw cap is threaded and matingly engages with said threaded protrusion of said outer gear head.

19. The liquid dispensing device of claim 18, wherein said inner gear head top portion includes a push button;

wherein said push button is engaged to pump a liquid out of said liquid dispensing device when said plurality of gear head receptacle base ring holes and said plurality of inner gear head holes are aligned with said plurality of outer gear head apertures.

20. The liquid dispensing device of claim 19, wherein an outside of said side portion of said outer gear head is threaded and includes a tab;

wherein said gear head receptacle further comprises a tab notch;

wherein said inside of said side portion of said gear head receptacle is threaded;

wherein said threaded outer gear head and said threaded gear head receptacle engage matingly when said outer gear head is inserted into said gear head receptacle;

wherein said tab allows a user to rotate said outer gear head with respect to said gear head receptacle.

* * * * *